US008256615B2

(12) United States Patent
Goda

(10) Patent No.: US 8,256,615 B2
(45) **Date of Patent: *Sep. 4, 2012**

(54) PACKAGING CONTAINER

(75) Inventor: Hideyuki Goda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 217 days.

This patent is subject to a terminal disclaimer.

(21) Appl. No.: 12/656,838

(22) Filed: Feb. 17, 2010

(65) Prior Publication Data

US 2010/0213088 A1 Aug. 26, 2010

(30) Foreign Application Priority Data

Feb. 24, 2009 (JP) ..... 2009-040232

(51) Int. Cl.
*B65D 19/00* (2006.01)

(52) U.S. Cl. ..... 206/386; 206/597; 206/600; 108/55.1

(58) Field of Classification Search ..... 206/386, 206/395, 598, 600, 596, 597, 599; 108/55.1, 108/55.5, 55.3
See application file for complete search history.

(56) References Cited

U.S. PATENT DOCUMENTS

| | | | | |
|---|---|---|---|---|
| 3,568,912 | A * | 3/1971 | de Simas | 206/598 |
| 4,383,609 | A * | 5/1983 | Lochmiller | 206/386 |
| 7,654,390 | B2 * | 2/2010 | Baechle et al. | 206/386 |
| 2006/0186072 | A1 | 8/2006 | Naruishi et al. | |
| 2007/0000920 | A1 | 1/2007 | Naruishi et al. | |
| 2009/0025342 | A1 | 1/2009 | Ishikawa et al. | |
| 2009/0242456 | A1 | 10/2009 | Goda | |

FOREIGN PATENT DOCUMENTS

| | | | |
|---|---|---|---|
| JP | S52-27434 | | 2/1977 |
| JP | S56-9662 | | 3/1981 |
| JP | S6367246 | * | 8/1986 |
| JP | 05065160 A | * | 3/1993 |

* cited by examiner

*Primary Examiner* — J. Gregory Pickett
*Assistant Examiner* — Andrew Perreault
(74) *Attorney, Agent, or Firm* — Harness, Dickey & Pierce, P.L.C.

(57) ABSTRACT

A packaging container includes a pallet, an enclosure base, an enclosure box, a sheet, and a set of fasteners. The pallet includes a bottom deck, a top deck, and a set of support members. The enclosure base is placed on the pallet top deck. The enclosure box is placed above the pallet top deck around the enclosure base, and includes a top wall, first and second pairs of opposed side walls, an open bottom, and a first set of through-holes. The sheet is passed across the pallet hollow structure and fastened to the enclosure box to connect the pallet to the enclosure box, and includes a center panel, a pair of side flaps, and a second set of through-holes. The set of fasteners are passed through the first and second sets of through-holes to fasten the sheet to the enclosure box from outside the enclosure box.

10 Claims, 11 Drawing Sheets

PACKAGING CONTAINER

CROSS-REFERENCE TO RELATED APPLICATIONS

The present patent application claims priority pursuant to 35 U.S.C. §119 from Japanese Patent Application No. 2009-040232, filed on Feb. 24, 2009, which is hereby incorporated by reference herein in its entirety.

BACKGROUND OF THE INVENTION

1. Field of the Invention

The present invention relates to a packaging container, and more particularly, to a packaging container using a pallet and enclosure box to package an article for storage and transport with tines of a forklift.

2. Discussion of the Background

Shipping containers are used to package large electronic equipment such as printers and photocopiers for storage and transport. A typical design of such containers includes an upper enclosure box to enclose an article therewithin, and a lower platform or pallet having an open-sided hollow structure to accommodate tines of a forklift during handling of the container. The enclosure box is made of corrugated cardboard with the pallet formed of wood or plywood for strength and durability, while cardboard pallets are often used depending on specific applications.

In most such containers, the pallet and enclosure box are secured to each other to form an integrated structure that prevents shifting of packaged articles during handling of the shipping container. To provide safe and efficient packaging of articles, various methods have been proposed to reliably secure an enclosure box to a pallet in an integrated pallet container.

For example, one conventional packaging container combines an enclosure box and a hollow pallet stacked one atop the other using a pair of straps encircling the stacked box and pallet. In this method, each strap is passed through side openings provided in the pallet, stretched across corners of the enclosure box placed on the pallet, and tightened with a buckle or fastener connecting its opposite ends to secure the enclosure box onto the pallet.

Another conventional packaging container uses a corrugated cardboard pallet having through-holes in its sides in addition to side openings to accommodate forklift tines, combined with an enclosure box having corresponding through-holes on sides near the bottom edge. This packaging container secures the enclosure box to the pallet by engaging attachments in the corresponding through-holes of the pallet and the enclosure box.

One drawback of the securing, technique using fastening straps is that the need for strapping the enclosure box and pallet makes it troublesome to assemble the container, and that handling the assembled container can damage the enclosure box where concentrated stresses are applied to those corners that are in contact with the encircling straps.

On the other hand, the packaging container having the pallet and enclosure box secured by corresponding through-holes is relatively easy to assemble, but requires the use of cardboard pallets rather than standard wood or plywood pallets, limiting practical application of this method to pallet containers integrally made of corrugated cardboard.

SUMMARY OF THE INVENTION

Exemplary aspects of the present invention are put forward in view of the above-described circumstances, and provide a novel packaging container used to package an article for handling with tines of a forklift.

In one exemplary embodiment, the novel packaging container includes a pallet, an enclosure base, an enclosure box, a sheet, and a set of fasteners. The pallet allows handling of the container with the forklift tines, and includes a bottom deck, a top deck, and a set of support members. The pallet rests on the bottom deck. The article is placed on the top deck. The set of support members are disposed between the top and bottom decks to form a hollow structure substantially rectangular in plan with first and second pairs of opposed open sides substantially perpendicular to the top and bottom decks. The top deck defines first and second planes different from each other on a bottom side thereof inside the pallet hollow. The forklift tines enter the pallet hollow only through the first pair of opposed open sides in a given direction to contact the first plane of the top deck. The enclosure base is placed on the pallet top deck to support the article thereon. The enclosure box is placed above the pallet top deck around the enclosure base to enclose the article therewithin, and includes a top wall, first and second pairs of opposed side walls, an open bottom, and a first set of through-holes. The top wall covers the article from above. The first and second pairs of opposed side walls extend from the top wall to surround the article from all sides. The open bottom is defined by the first and second pairs of side walls opposite to the top wall to allow entry of the article therewithin during installation to the pallet top deck. The first set of through-holes is defined in the first pair of side walls adjacent to the open bottom. The sheet is passed across the pallet hollow structure and fastened to the enclosure box to connect the pallet to the enclosure box, and includes a center panel, a pair of side flaps, and a second set of through-holes. The center panel extends between the second pair of opposed open sides along the second plane and apart from the first plane inside the pallet hollow. The pair of side flaps extends upward from opposed ends of the center panel through the second pair of opposed open sides to beyond the first set of through-holes. The second set of through-holes is defined in the pair of side panels to align with the first set of through-holes. The set of fasteners are passed through the first and second sets of through-holes to fasten the sheet to the enclosure box from outside the enclosure box.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
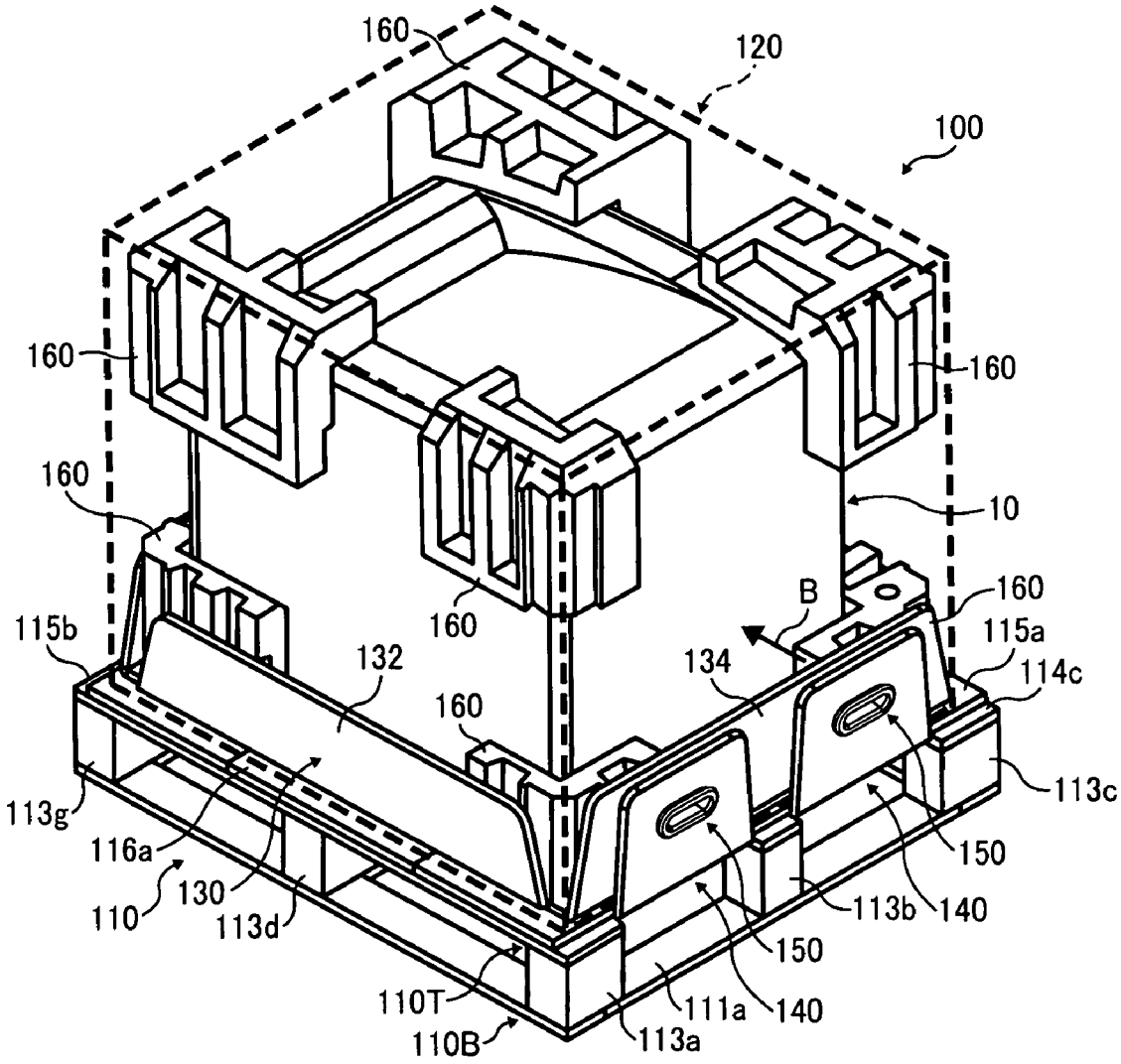
FIG. 1 is an assembled perspective view schematically illustrating a packaging container according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 2:
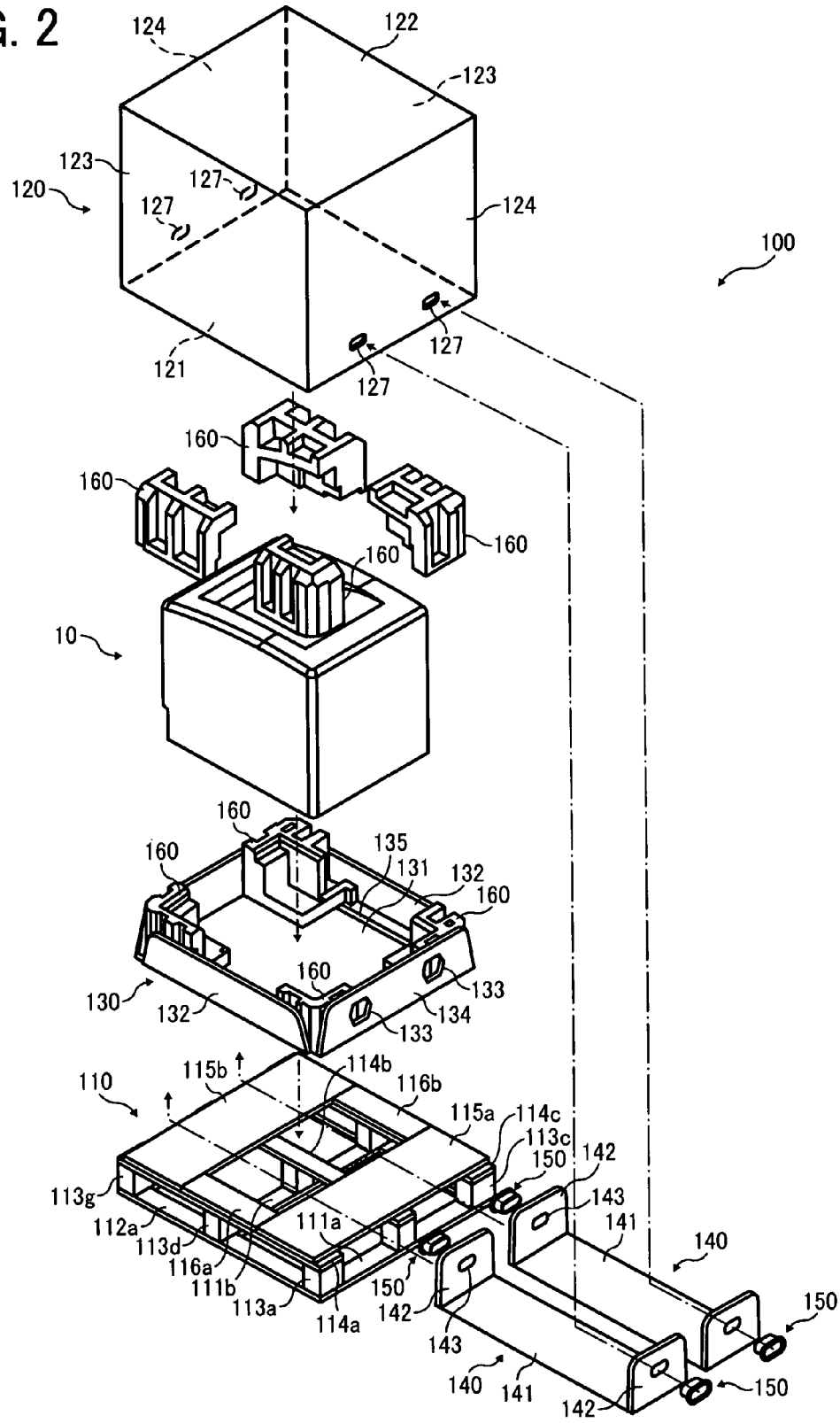
FIG. 2 is an exploded perspective view of the packaging container of FIG. 1.
Figure 3:
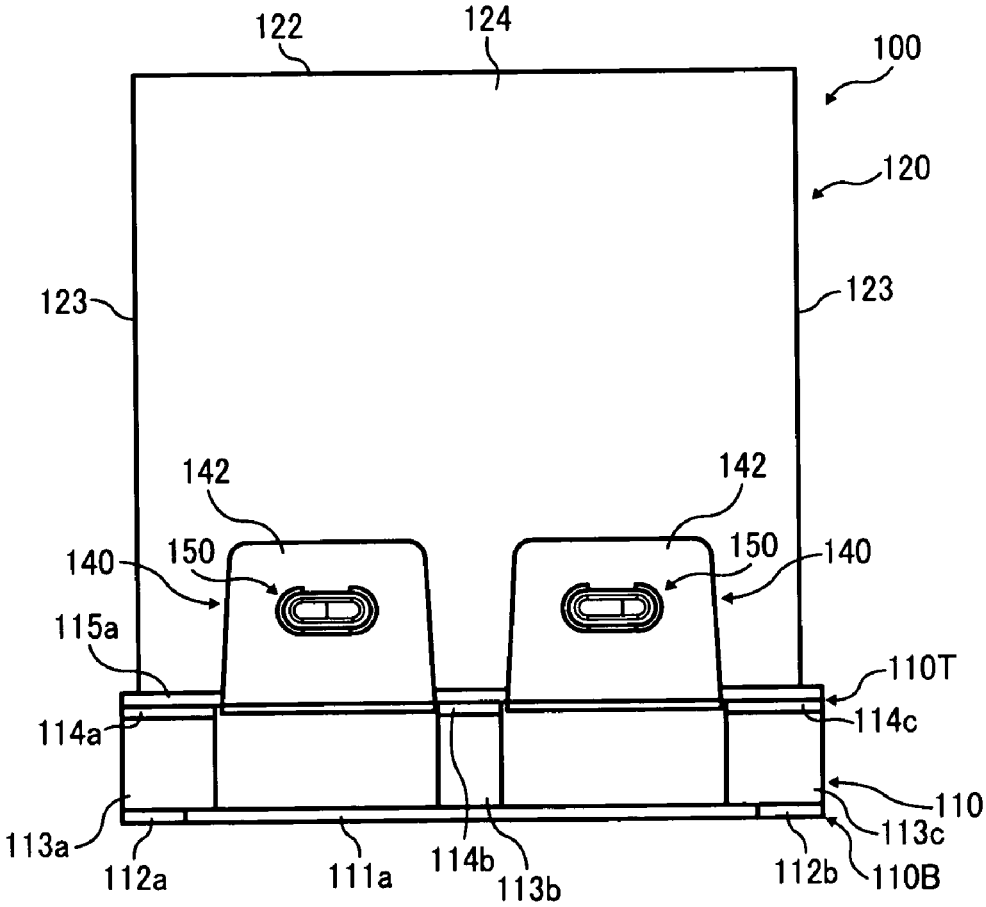
FIG. 3 is a side view of the packaging container taken in the direction of arrow B of FIG. 1.

FIGS. 1 and 2 are assembled and exploded perspective views, respectively, schematically illustrating a packaging container 100 according to one embodiment of this patent specification, and FIG. 3 is a side view of the packaging container 100 taken in the direction of arrow B of FIG. 1.

As shown in FIGS. 1 through 3, the container 100 includes a pallet 110, an open-ended enclosure box 120, an enclosure base 130, a pair of sheets 140, a set of fasteners 150, and eight corner pads 160, all of which are assembled into an integrated structure for packaging an article 10, such as a printer, for storage or transport.

The pallet 110 lies at the bottom of the container 100 to allow handling with tines or forks of a forklift. On the pallet 110, the enclosure box 120 encloses the article 10 cushioned by the corner pads 160, with the enclosure base 130 lying between the article 10 and the pallet 110 to hold the article 10 in place within the box 120. Each sheet 140 extends through and across a width of the pallet 110 and fastened to the enclosure box 120 with the fasteners 150 to secure the pallet 110 to the enclosure box 120.

Figure 4:
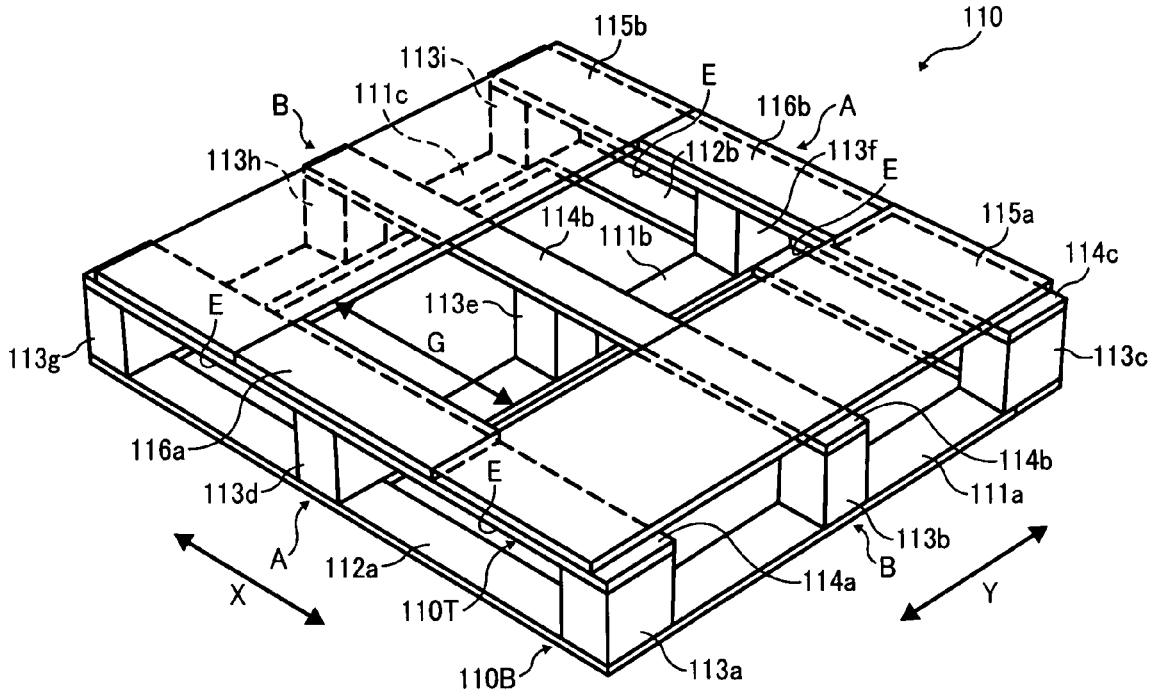
FIG. 4 is a perspective view schematically illustrating a pallet for use in the packaging container of FIGS. 1 through 3.

FIG. 4 is a perspective view schematically illustrating the pallet 110 for use in the packaging container 100 of FIGS. 1 through 3.

As shown in FIG. 4, the pallet 110 has an open-sided hollow structure made of wood or plywood, substantially rectangular in plan, with a first pair of parallel opposed sides A extending in a transverse direction X and a second pair of parallel opposed sides B extending in a longitudinal direction Y, including a bottom deck 110B forming a load-bearing surface at the bottom on which the pallet 110 rests; a top deck 110T forming a load-carrying surface at the top on which the article 10 is placed; and nine support blocks 113*a* through 113*i* disposed between the top and bottom decks 110T and 110B, one in the midpoint of the rectangle, four on the rectangle corners, and the other four between the rectangle corners, to define forklift entries E on the first pair of opposed sides A through which the forklift tines enter the pallet hollow between the top and bottom decks 110T and 110B.

Specifically, the bottom deck 110B includes three parallel deckboards 111*a* through 111*c* extending in the longitudinal direction Y and two parallel deckboards 112*a* and 112*b* extending in the transverse direction X. The longitudinal and transverse bottom deckboards 111 and 112 are combined to together form the pallet load-bearing surface at their bottom in a substantially planar configuration.

The top deck 110T includes three parallel deckboards 114*a* through 114*c* extending in the transverse direction X and two parallel deckboards 115*a* and 115*b* extending in the longitudinal direction Y. The transverse and longitudinal deckboards 114 and 115 are stacked one atop another, so that the transverse top deckboards 114 together form a substantially horizontal, first plane at their bottom, and the longitudinal top deckboards 115 together form a substantially horizontal, second plane at their bottom above and different from the first plane, as well as the pallet load-carrying surface at their top in a substantially planar configuration.

The transverse top deckboards 114*a* through 114*c* are spaced apart from each other, of which two lie along the first pair of opposite sides A, to define multiple gaps therebetween extending in the transverse direction X. The longitudinal top deckboards 115*a* and 115*b* are spaced apart from each other to define a top deck gap G therebetween extending in the longitudinal direction Y. The longitudinal deckboards 115 have their outer edges spaced inward from adjoining edges of the transverse deckboards 114 on the second pair of opposed sides B.

The top deck 110T is provided with a pair of spacers 116*a* and 116*b* between the longitudinal deckboards 115*a* and 115*b*, one on the transverse deckboard 114*a* and the other on the transverse deckboard 114*c*. The spacers 116*a* and 116*b* are generally flat pieces of wood or plywood, each with a width substantially equal to that of the transverse deckboard 114, a length substantially equal to the top deck gap G, and a height substantially equal to that of the longitudinal deckboard 115. Each spacer 116 thus fits in the top deck gap G with its side edges aligned with adjoining edges of the transverse deckboard 114, and upper surface level and flush with the longitudinal deckboards 115*a* and 115*b* to form part of the planar load-carrying surface.

In the assembled container 100, the pallet 110 is secured to the enclosure box 120 with the sheets 140 passed through the gaps between the transverse top deckboards 114 along the second plane on the bottom of the longitudinal top deckboards 115, while allowing entry of the forklift tines only through the entry openings E on the first pair of opposed sides A to contact the first plane on the bottom of the transverse top deckboards 114.

Such a configuration prevents the sheets 140 from interfering with the forklift tines entering the pallet hollow, which, if properly operated, do not reach above the transverse deckboards 114 to damage the sheets 140 when lifting the pallet 10.

Further, the top deck gap G provided between the longitudinal deckboards 115*a* and 115*b* allows a portion of the enclosure base 130 to engage the inner edges of these deckboards 115 to restrict movement of the enclosure base 130 over the load-carrying surface, as will be described later with reference to FIG. 6. The spacers 116 disposed between the longitudinal deckboards 115*a* and 115*b* prevent dust and other contaminants from entering the enclosure box 120 through the top deck gap G. These spacers 116, having the substantially same width as the underlying transverse deckboards 114, do not project inward beyond the adjoining edges of the deckboards 114 to interfere with proper engagement of the enclosure base 130 with the longitudinal deckboards 115 within the top deck gap G.

Still further, the outer edges of the longitudinal deckboards 115 spaced inward from the adjoining edges of the transverse deckboards 114 on the second pair of opposed sides B allow the sheets 140 to extend therealong inward from the edges of the transverse deckboards 114. This prevents the sheets 140 from possibly interfering with surrounding structures (e.g., another packaging container), which would otherwise damage the sheet 140 to break the connection between the enclosure box 120 and the pallet 110.

Referring back to FIG. 2, the enclosure box 120 comprises an open-ended, generally rectangular box formed of corrugated cardboard, with an open bottom 121 smaller in dimension than the load-carrying surface of the pallet 110; a top wall 122 opposed to the open bottom 121; first and second pairs of parallel side walls 123 and 124 extending vertically from the top wall 122 to the open bottom opening 121; and four through-holes 127, two on each side wall 124 adjacent to the open bottom 121. The box walls 122, 123, and 124 are dimensioned to accommodate the height and width of the article 10.

In the assembled container 100, the enclosure box 120 is placed on the pallet 110 around the enclosure base 130, with the first pair of side walls 123 on the first pair of opposed sides A and the second pair of side walls 124 on the second pair of opposed sides B, so that the four edges of the open bottom 121 (or those of the side walls 123 and 124) contact the upper surfaces of the longitudinal top deckboards 115 and the top deck spacers 116. Thus, the top wall 122 covers the article 10 from above and the side walls 123 and 124 surround the article 10 from all sides. The through-holes 127 are positioned on the second pair of opposed sides B, where the sheets 140 are fastened to the side walls 124 of the enclosure box 120 with the fasteners 150, as will be described with reference to FIGS. 8A through 8C.

With continued reference to FIG. 2, the enclosure base 130 comprises a generally rectangular receptacle formed of corrugated cardboard, having a substantially rectangular center panel 131 sufficiently larger than the bottom of the article 10 and smaller than the bottom 121 of the enclosure box 120; first and second pairs of side flaps 132 and 134 each extending upward from opposed parallel edges of the center panel 131; four openings 133, two on each of the second pair of side flaps 134. Although not depicted in the drawing, the enclosure base 130 is also provided with positioning slots cut at four corners of the center panel 131 for anchoring the support blocks 160 deployed on the enclosure base 130.

In the assembled container 100, the enclosure base 130 is placed on the pallet 110 with the first pair of side flaps 132 on the first pair of opposed sides A and the second pair of side flaps 134 on the second pair of opposed sides B. The transverse and longitudinal side flaps 132 and 134 hold the support blocks 160 in line with the edges of the center panel 131, while each positioning slot in the center panel 131 engages a protrusion provided on the bottom of each support block 160. This holds the support blocks 160 in position with respect to each other, which in turn properly positions the article 10 cushioned by the support blocks 160 within the enclosure box 120.

Further, the openings 133 of the longitudinal side flaps 134 face the through-holes 127 of the enclosure box 120. These openings 133 are larger in size than the through-holes 127, and serve to prevent the fasteners 150 from interfering with the side flaps 133 during installation.

Figure 6:
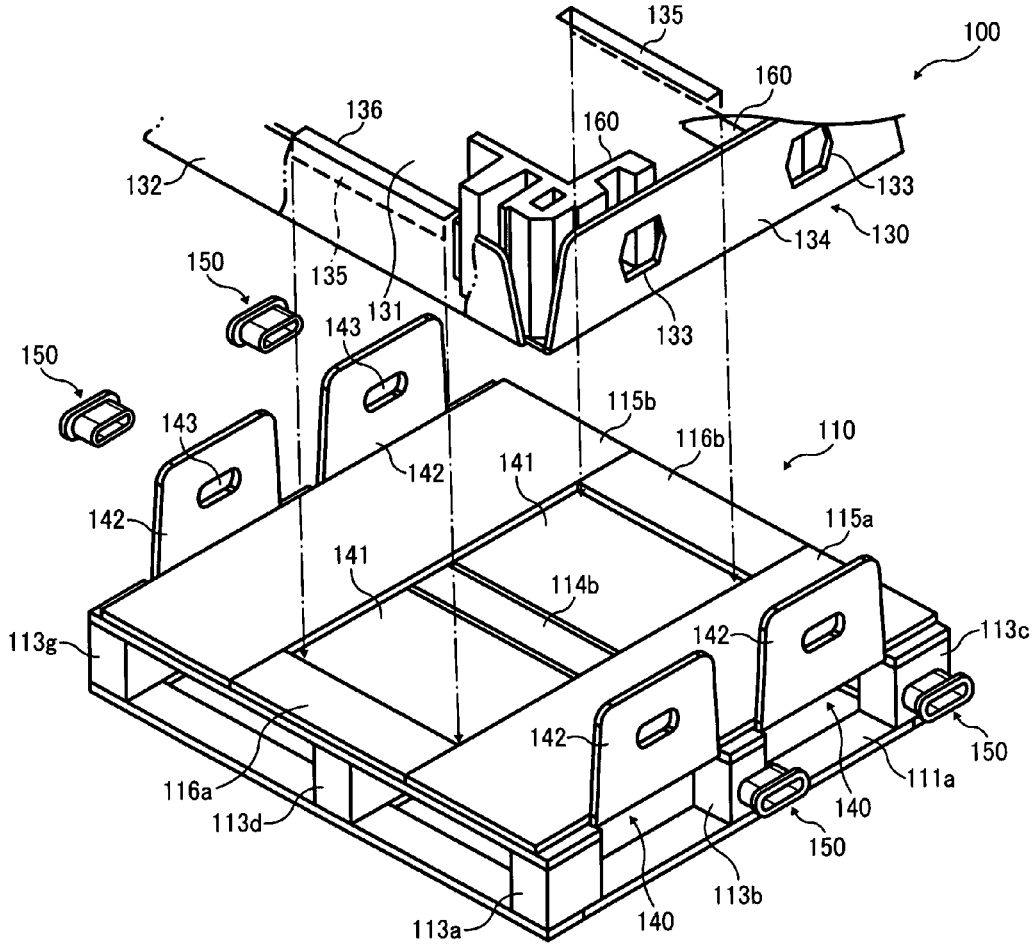
FIG. 6 is an enlarged, partially cut-away, exploded perspective view of the packaging container of FIG. 1.

With additional reference to FIG. 6, which is an enlarged, partially cut-away, exploded perspective view of the packaging container 100, the enclosure base 130 also has a pair of positioning tabs 135 each being cut out of the center panel 131 to form a rectangular slot 136 and bent to one side of the slot 136 downward from the plane of the center panel 131. The positioning tabs 135 are accommodated in the top deck gap G, each with opposed edges abutting on the adjoining edges of the longitudinal top deckboards 115*a* and 115*b* to restrict movement of the enclosure base 130 over the load-carrying surface of the pallet 110. These tabs 135 are sized to project downward only a distance sufficient to stabilize the enclosure base 130, and do not interfere with proper placement of the sheets 140 along the second plane below the longitudinal top deckboards 115.

Figure 5:
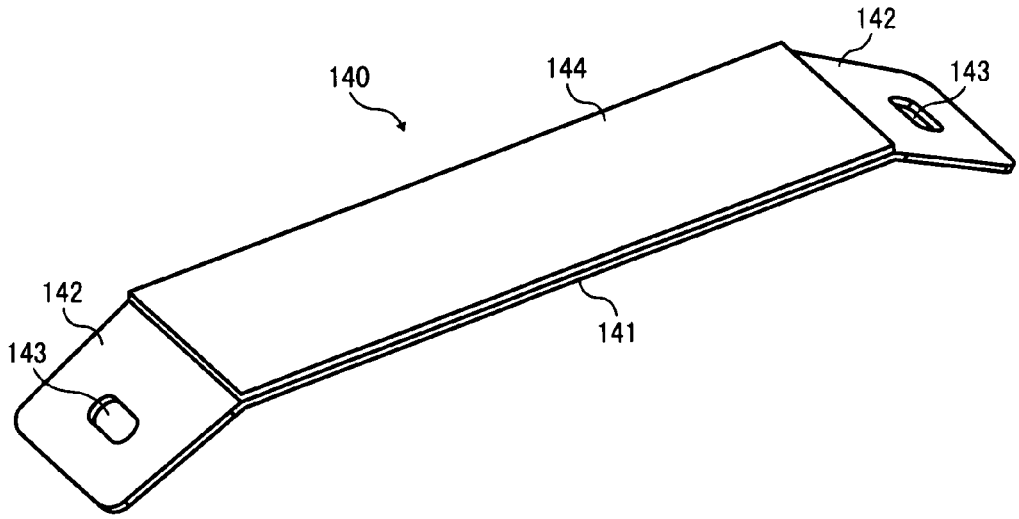
FIG. 5 is a perspective view of a sheet, shown bottom side up, before assembly into the packaging container of FIG. 1.

FIG. 5 is a perspective view of the sheet 140, shown bottom side up, before assembly into the packaging container 100 according to one embodiment of this patent specification.

As shown in FIG. 5, the sheet 140 comprises a piece of corrugated cardboard with a substantially rectangular center panel 141; a pair of side flaps 142 extending outward from opposed parallel sides of the center panel 141; two through-holes 143 one on each side flap 142; and a backing panel 144 attached to bottom side of the center panel 141.

The center panel 141 has a width slightly smaller than that of the gap between two adjoining transverse top deckboards 114, a length slightly greater than the distance between the outer edges of the longitudinal top deckboards 115*a* and 115*b*, and a thickness not greater than that of the transverse top deckboards 114. The backing panel 144 has a thickness substantially equal to the difference between the sheet and deckboard thicknesses, so that the total thickness of the panels 141 and 144 is substantially equal to the height of the transverse top deckboards 114.

With additional reference to FIGS. 1 through 3 and 6, in the assembled container 100, each sheet 140 has the center panel 141 passed through the gap between the transverse top deckboards 114. The side flaps 142 project upward from between the transverse top deckboards 114 to beyond the through-hole 127 of the enclosure box 120, and are fastened to the side walls 124 of the enclosure box 120 with the fasteners 150 inserted through the sheet through-holes 147 and the box through-holes 127 aligned with each other. Thus, the sheet 140 secures the pallet 110 to the enclosure box 120 while covering the top deck gap G of the pallet 110 from below for secure and safe handling with forklift tines.

In such a configuration, the center panel 141 fitting the gap between the transverse top deckboards 114 rests along the second plane on the bottom of the longitudinal deckboards 115 and away from the first plane on the bottom of the transverse deckboards 114 which the forklift tines contact when lifting the pallet 110. As mentioned, this prevents the sheets 140 from interfering with the forklift tines entering the pallet hollow, which, if properly inserted, do not reach above the transverse deckboards 114 to damage the sheets 140 when lifting the pallet 10.

Further, the backing panel 144 attached to the back of the center panel 141 has an exposed surface level with the first plane of the pallet top deck 110T to contact the forklift tines entering the pallet hollow. This enables the forklift tines to proceed through the pallet hollow without snagging on the interior of the pallet 110, and to hold the pallet 110 for transport without drifting or slipping even if the tines are not completely inserted, which would otherwise result in instability or tipover of the container being hauled.

Furthermore, the side flaps 142 extending upward along the edges of the longitudinal deckboards 115 rest inward from the edges of the transverse top deckboards 114 on the second pair of opposed sides B. As mentioned, this prevents the sheet 140 from possibly interfering with surrounding structures, which would otherwise damage the side flap 142 to break the connection between the enclosure box and the pallet.

Figure 7:
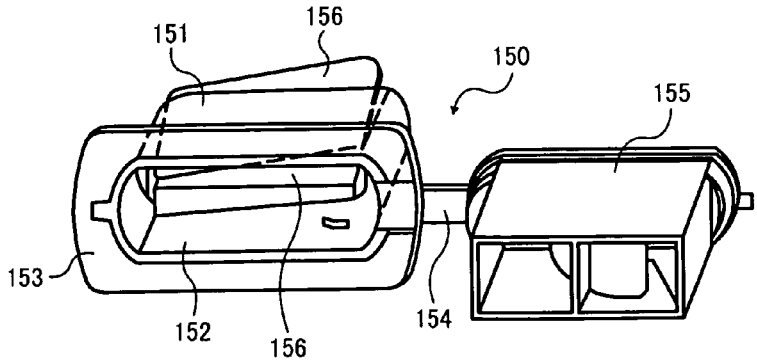
FIG. 7 schematically illustrates an example of a fastener for use in the packaging container of FIG. 1.

FIG. 7 schematically illustrates an example of the fastener 150 for use in the packaging container 100.

As shown in FIG. 7, the fastener 150 is constituted of an open-ended tubular body 151, substantially oval in cross-section, having one open end surrounded by a flange 153 and the other open end having a pair of angled plates 156, each forming an "L" in cross-section and hinged to an inner wall of the tubular body 151, and a plug 155 connected to the flange 153 via a hinge 154, all of which are formed as a single integrated unit made of synthetic resin. Before use, the fastener 150 has the plug 155 outside the tubular body 151 so that the hinged plates 156 point their free ends in the same direction. This allows the flange-less end of the tubular body 150 to enter an opening of a particular size. Inserting the plug 155 into the tubular body 151 causes the plates 156 to turn on their respective hinges, which enables the fastener 150 to hold together walls of a certain thickness between the flange 153 and the plates 156.

Figure 8A:
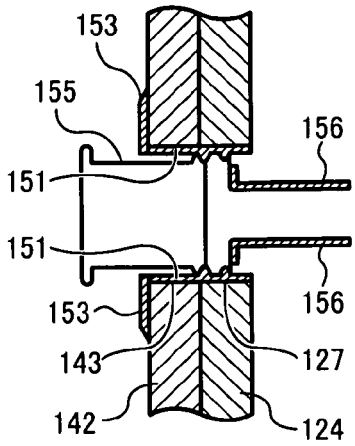
FIGS. 8A through 8C are cross-sectional views schematically illustrating the fastener of FIG. 7 in use to fasten the sheet to the enclosure box.
Figure 8B:
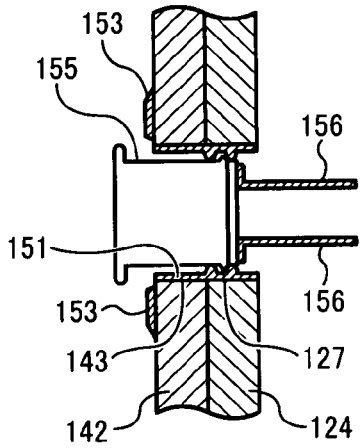
Figure 8C:
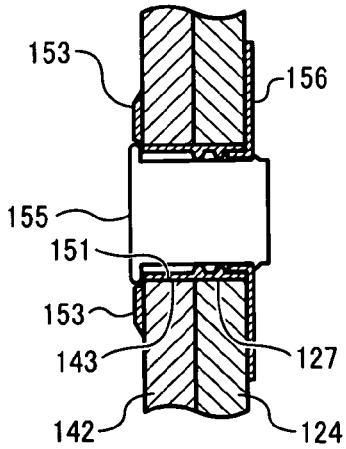

FIGS. 8A through 8C are cross-sectional views schematically illustrating the fastener 150 in use to fasten the sheet 140 to the enclosure box 120.

To install the fastener 150, first, the tubular body 151 is inserted into the aligned through-holes 143 and 127 of the sheet flap 142 and the enclosure wall 124 with the plug 155 remaining outside or partially inside the tubular body 151. The tubular body 151 is squeezed until the flange 153 comes into contact with the sheet flap 142 (FIG. 8A).

After inserting the tubular body 151, the plug 155 is inserted into the tubular body 151 from the flanged end toward the flange-less end (FIG. 8B).

The inserted plug 155 ultimately comes into contact with the hinged plates 156 to turn them approximately 90 degrees outward on their respective hinges, thereby engaging the tubular body 151 in the aligned through-holes 143 and 127. Thus, the fastener 150 connects together the sheet flap 142 and the box wall 124 by abutting the flange 153 against the sheet flap 142 at one end, and the plates 156 against the box wall 124 at the other end (FIG. 8C).

To release the connection between the sheet flap 142 and the box wall 124, the fastener 150 is removed by retracting the plug 155 away from the flange-less end of the tubular body 151, returning the hinged plates 156 to their original positions, and then drawing the tubular body 151 away from the through-holes 127 and 143.

Thus, the fastener 150 provides secure connection between the enclosure box 120 and the sheet 140 through operation from outside the enclosure box 120 without requiring special tools for installation and releasing.

Referring back to FIGS. 1 and 2, the eight corner pads 160, four between the enclosure base 130 and the article 10 and four between the article 10 and the box 120, are formed of plastic foam, such as expanded polystyrene (EPS) or expanded polyethylene (EPE), and are shaped to conform to the shape of the article 10 so as to cushion and hold the article 10 at eight corners of the container 100.

Specifically, the lower four pads 160 prevent horizontal displacement of the article 10, and the upper four pads 160 prevent vertical displacement of the article 10. As mentioned earlier, the lower pads 160 each has a protrusion on the bottom side for engaging in the positioning slot at the corner of the enclosure base 130, which anchors the pads 160 on the enclosure base 130 for reliably positioning the cushioned article 10 on the enclosure base 130.

Having described configurations of the respective elements of the packaging container 100, the following describes procedures for packaging the article 10 in the container 100 with particular reference to FIG. 2.

First, the enclosure base 130 is placed on the top deck 110T of the pallet 110 with the transverse and longitudinal side flaps 132 and 134 each folded upward-along the edges of the center panel 131, and the positioning tabs 135 each folded downward to one side of the slot 136. The enclosure base 130 is positioned where the tabs 135 fit in the top deck gap G between the longitudinal top deckboards 115*a* and 115*b* against the respective top deck spacers 116*a* and 116*b*.

After positioning the enclosure base 130, the four corner pads 160 are placed on the respective corners of the enclosure base 130, each with the bottom protrusion engaged with the corresponding positioning slot provided in the enclosure base 130. Then, the article 10 is placed on the lower pads 160, followed by putting the additional four pads 160 on the upper corners of the article 10, thereby positioning the article 10 above the pallet 110.

Subsequently, the enclosure box 120 is placed onto the pallet 110 over the article 10, which enters the enclosure box 120 from below through the open bottom 121. When set in place, the enclosure box 120 has the bottom edges (i.e., the lower edges of the side walls 123 and 124, or the perimeter of the open bottom 121) resting on the upper top deckboards 115 and the top deck spacers 116 around the perimeter of the enclosure base 130.

The upper top deckboards 115 and the spacers 116, having a substantially equal height from the lower top deckboards 114, form a substantially even, planar load-carrying surface which can maintain continuous contact with the box bottom edges. This prevents damage to the box 120 by distributing thereacross loads applied thereto, allowing for stacking of multiple containers without breakage, while preventing dust and other contaminants from entering the enclosure box 120 through the top deck gap G.

After placing the enclosure box 120, the sheets 140 are inserted between the top and bottom decks 110T and 110B through the gaps between the transverse top deckboards 114, followed by folding the flaps 142 upward along the edges of the center panel 141 and bringing the center panel 141 into contact with the second plane or bottom of the longitudinal top deckboards 115*a* and 115*b*.

The sheet 140 thus wrapping the top deck 110T of the pallet 110 is fastened to the enclosure box 120 by engaging the fasteners 150 into the through-holes 143 and 127 aligned with each other, thereby completing assembly of the container 100. As mentioned earlier, the enclosure base 130 inside the enclosure box 120 does not interfere with installation of the fasteners 150 owing to the openings 133 providing clearance between the fasteners 150 and the longitudinal side flaps 134.

The completed container 100 is ready for handling by a forklift. In the container 100, the pallet 110 is secured to the enclosure box 120 by the sheets 140, while connected to the enclosure base 130 with the positioning tabs 135 engaged in the top deck gap G. Such secure connection in turn stabilizes the enclosed article 10 during handling with the forklift, since the article 10 is held to the walls of the enclosure box 120 and the enclosure base 130 through the cushioning pads 160. When required, the container 100 allows access to the enclosed article 10 by removing the enclosure box 120 from the pallet 110 through the ready and tool-less operation of the fasteners 150 as mentioned above.

Figure 9:
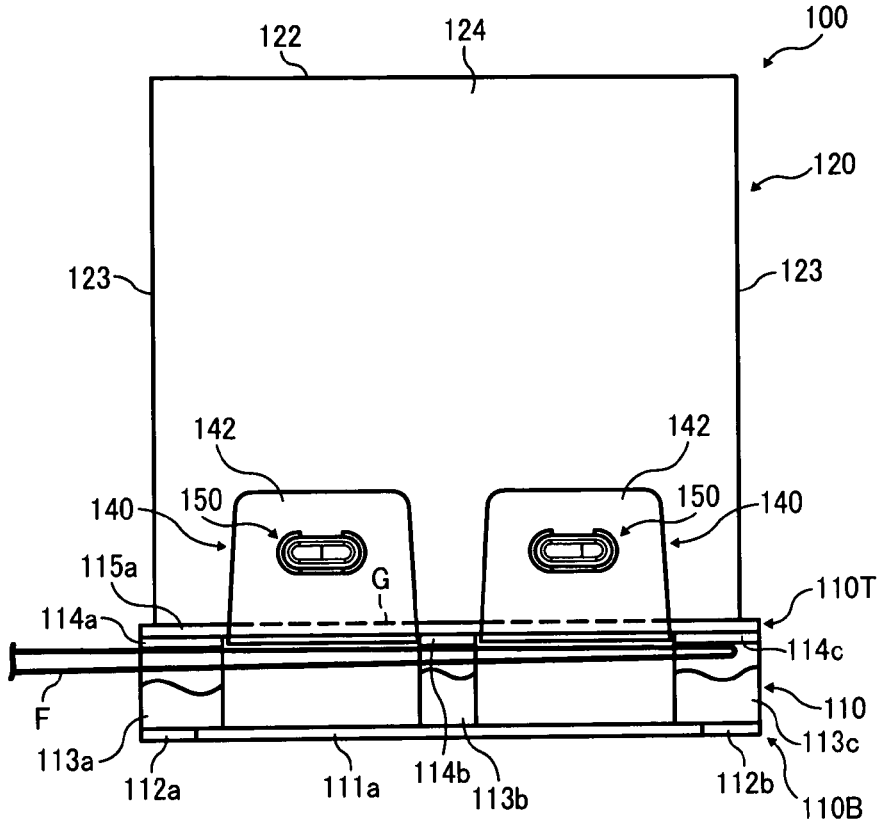
FIG. 9 is a partially cut-away side view schematically illustrating the assembled container of FIG. 1 during handling with forklift tines.

FIG. 9 is a partially cut-away side view schematically illustrating the assembled container 100 during handling with forklift tines F.

As shown in FIG. 9, to handle the container 100, the forklift tines F enter the pallet hollow between the top and bottom decks 110T and 110B through the entry openings E provided on either of the first pair of opposed sides A.

Owing to the sheets 140 and the enclosure base 130 sandwiching the top deck gap G from below and above the longitudinal top deckboards 115, the container 100 prevents the forklift tines F from accidentally thrusting into the enclosure box 120 through the gap G to damage the enclosed article 10, even when the tips of the tines F are inappropriately positioned immediately below the gap G.

Further, the backing panel 144 attached to the back of the center panel 141 of the sheet 140 enables the forklift tines F to proceed through the pallet hollow without snagging on the interior of the pallet 110, and to uniformly contact the bottom of the top deck 110T to hold the pallet 110 reliably. The sheet center panel 141 disposed along the second plane and away from the first plane of the top deck 110T does not interfere with or become damaged by the forklift tines F inside the pallet hollow.

Thus, the packaging container 100 according to this patent specification enables secure connection between the enclosure box and pallet, which provides good protection of the enclosure against breakage as well as ready and tool-less assembly and disassembly of the integrated container.

Figure 10:
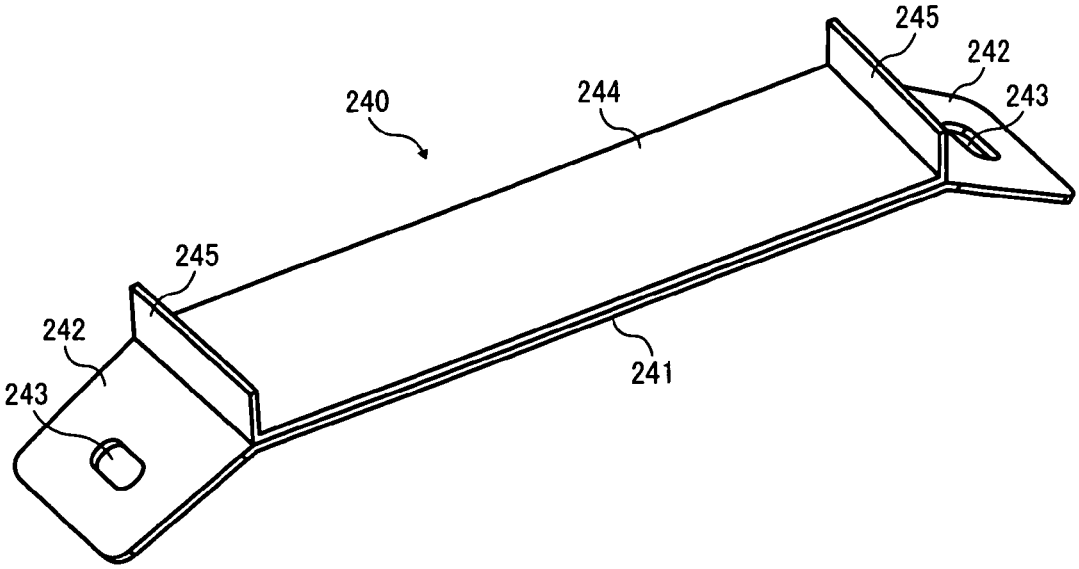
FIG. 10 is a perspective view of a sheet, shown bottom side up, before assembly into the packaging container of FIG. 1 according to another embodiment of this patent specification.

FIG. 10 is a perspective view of a sheet 240, shown bottom side up, before assembly into the packaging container 100 according to another embodiment of this patent specification.

As shown in FIG. 10, the general configuration of the sheet 240, including a center panel 241, side flaps 242, throughholes 243, and a backing panel 244, is similar to that depicted primarily in FIG. 5, except that the sheet 240 additionally includes a pair of bottom tabs 245 extending from between the center panel 241 and the respective side flaps 242 toward the bottom side.

Figure 11:
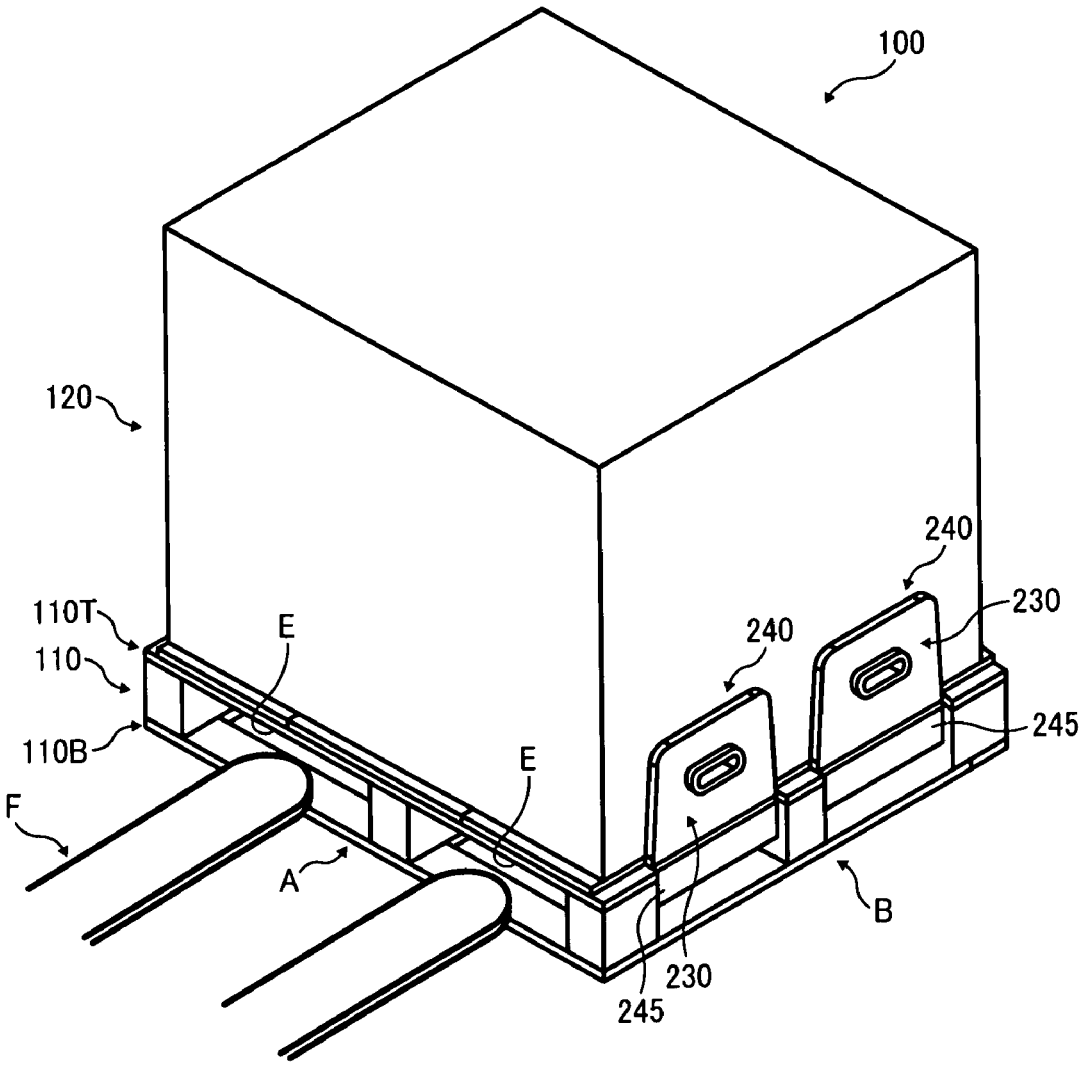
FIG. 11 is a perspective view schematically illustrating the packaging container assembled using the sheet of FIG. 10.

FIG. 11 is a perspective view schematically illustrating the packaging container 100 assembled using the sheets 240 of FIG. 10.

As shown in FIG. 11, when assembled into the container 100, the sheets 240 have their bottom tabs 245 extending downward from the edges of the side flaps 230 to occupy the openings on the second pair of opposed sides B of the pallet 110. This visually indicates that the forklift tines F cannot enter into these openings, thereby assisting an operator to insert the forklift tines F into the correct entries E provided on the first pair of opposed sides A.

Figure 12:
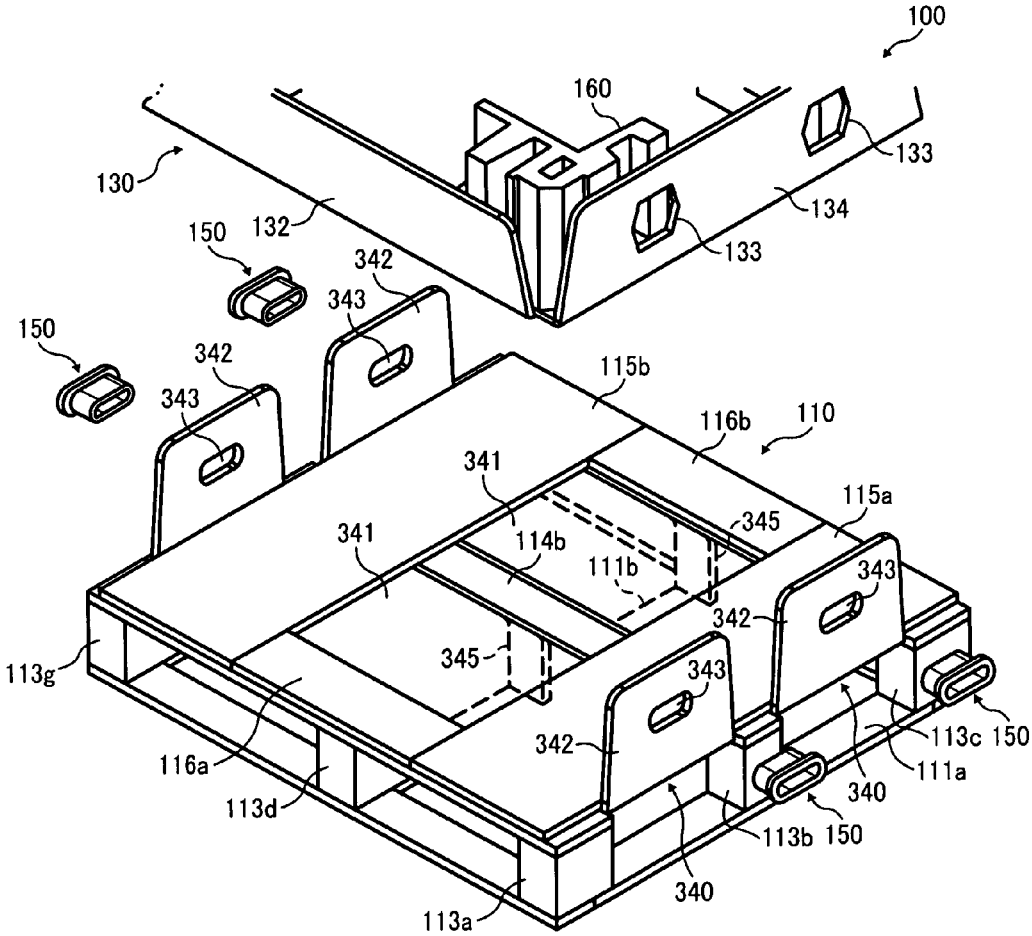
FIG. 12 is an enlarged, exploded partial perspective view schematically illustrating the packaging container of FIG. 1 using a pair of sheets according to another embodiment of this patent specification.

FIG. 12 is an enlarged, exploded partial perspective view schematically illustrating the packaging container 100 using a pair of sheets 340 according to another embodiment of this patent specification.

As shown in FIG. 12, the general configuration of the sheet 340, including a center panel 341, side flaps 342, throughholes 343, and backing panel 344, not shown, is similar to that primarily depicted in FIGS. 5 and 6, except that the sheet 340 additionally includes a pair of propping positioning tabs 345 extending downward from the center panel 341 to rest on the bottom longitudinal deckboard 111*b* when assembled. The positioning tabs 345 serve to retain the center panel 341 in position along the bottom of the longitudinal top deckboards 115, which prevents the sheet 340 from bowing and sagging to interfere with the forklift tines inserted into the pallet 110.

Figure 13:
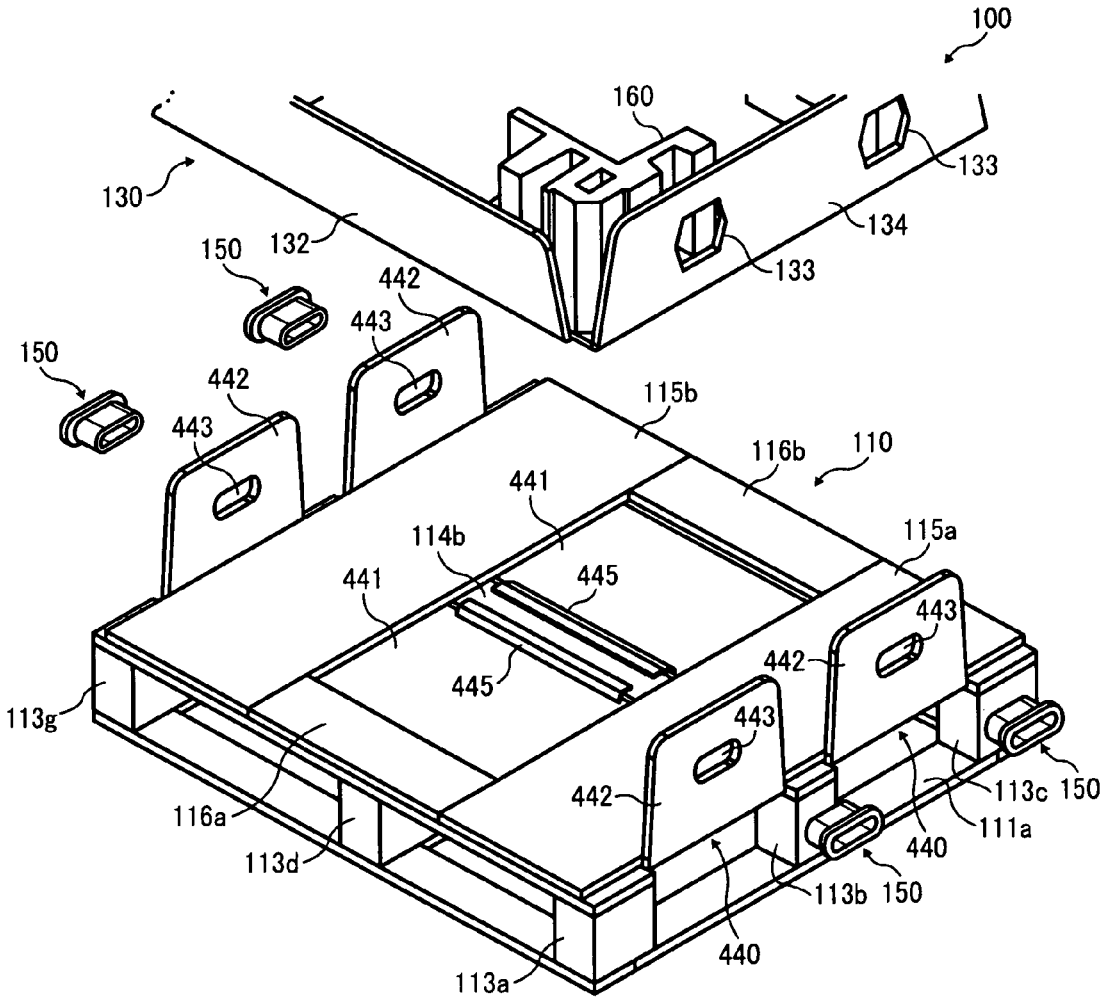
FIG. 13 is an enlarged, exploded partial perspective view schematically illustrating the packaging container of FIG. 1 using a pair of sheets according to still another embodiment of this patent specification.

FIG. 13 is an enlarged, exploded partial perspective view schematically illustrating the packaging container 100 using a pair of sheets 440 according to still another embodiment of this patent specification.

As shown in FIG. 13, the general configuration of the sheet 440, including a center panel 441, side flaps 442, throughholes 443, and a plate 444, not shown, is similar to that primarily depicted in FIGS. 5 and 6, except that the sheet 440 additionally includes a hooking positioning tab 445 extending upward from the center panel 341 onto the center transverse top deck board 114*b* when assembled. The positioning tab 445 serves to retain the center panel 441 in position along the bottom of the longitudinal top deckboards 115, which prevents the sheet 440 from bowing and sagging to interfere with the forklift tines inserted into the pallet 110.

Figure 14:
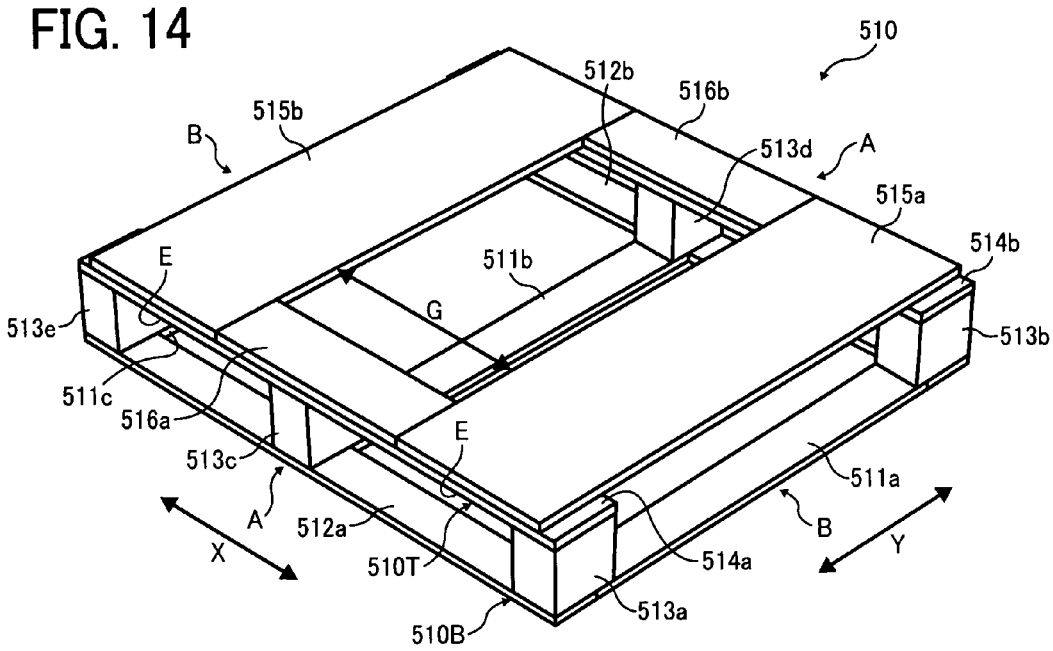
FIG. 14 is a perspective view schematically illustrating a pallet for use in a packaging container according to further embodiment of this patent specification.

FIG. 14 is a perspective view schematically illustrating a pallet 510 for use in the packaging container 100 according to a further embodiment of this patent specification.

As shown in FIG. 14, the pallet 510 has an open-sided hollow structure made of wood or plywood, substantially rectangular in plan, with a first pair of parallel opposed sides A extending in a transverse direction X and a second pair of parallel opposed sides B extending in a longitudinal direction Y, including a bottom deck 510B forming a load-bearing surface at the bottom on which the pallet 510 rests; a top deck 510T forming a load-carrying surface at the top on which the article 10 is placed; and six support blocks 513*a* through 513*f* disposed between the top and bottom decks 510T and 510B to define forklift entries E on the first pair of opposed sides A through which the forklift tines enter the pallet hollow between the top and bottom decks 510T and 510B.

Specifically, the bottom deck 510B includes three parallel deckboards 511*a* through 511*c* extending in the longitudinal direction Y and two parallel deckboards 512*a* and 512*b* extending in the transverse direction X. The longitudinal and transverse bottom deckboards 511 and 512 are combined to together form the pallet load-bearing surface at their bottom in a substantially planar configuration.

The top deck 510T includes two parallel deckboards 514*a* and 514*b* extending in the transverse direction X and two parallel deckboards 515*a* and 515*b* extending in the longitudinal direction Y. The transverse and longitudinal deckboards 514 and 515 are stacked one atop another so that the transverse top deckboards 514 together form a substantially horizontal, first plane at their bottom, and the longitudinal top deckboards 515 together form a substantially horizontal, second plane at their bottom above and different from the first plane, as well as the pallet load-carrying surface at their top in a substantially planar configuration.

The transverse top deckboards 514*a* and 514*b* are spaced apart from each other to define a gap therebetween extending in the transverse direction X. The longitudinal deckboards 515*a* and 515*b* are spaced apart from each other to define a top deck gap G therebetween in the longitudinal direction Y. The longitudinal deckboards 515 have their outer edges spaced inward from adjoining edges of the transverse deckboards 514 on the second pair of opposed sides B.

The top deck 510T is provided with a pair of spacers 516*a* and 516*b* between the longitudinal deckboards 515*a* and 515*b*, one on the transverse deckboard 514*a* and the other on the transverse deckboard 514*b*, similar in configuration to the spacers 116*a* and 116*b* depicted in the embodiment described with reference to FIG. 4.

Figure 15:
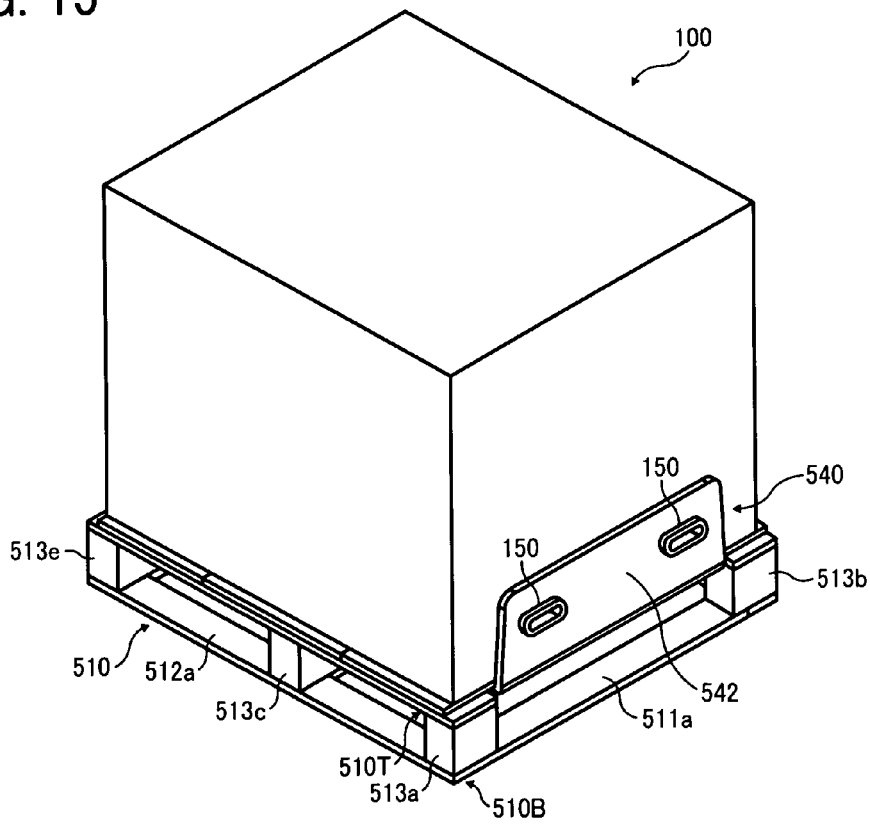
FIG. 15 is a perspective view schematically illustrating the packaging container assembled using the pallet of FIG. 14.

With additional reference to FIG. 15, which is a perspective view schematically illustrating the packaging container 100 assembled using the pallet 510, it can be seen the pallet 510 is secured to the enclosure box 120 with a single sheet 540 instead of the paired sheets used in the embodiments described above. Although not fully depicted in the drawing, the basic configuration of the sheet 540 is similar to those depicted primarily in FIGS. 5, 6, 10, 12, and 13, except that the sheet 540 has a center panel 541 having a width substantially equal to that of the gap between the two transverse top deckboards 514*a* and 514*b*, which is larger than the gap between adjoining two of the three transverse top deckboards 114*a* through 114*c*, with a pair of side flaps 542 extending from opposed edges of the center panel 541 and four through-holes 543, two on each side flap 542.

In the assembled container 100, the pallet 510 is secured to the enclosure box 120 with the single sheet 540 passed through the gap between the transverse top deckboards 514*a* and 514*b* along the second plane on the bottom of the longitudinal top deckboards 515, while allowing entry of the forklift tines only through the entry openings E on the first pair of opposed sides A to contact the first plane on the bottom of the transverse top deckboards 514.

Such a configuration enables secure connection between the enclosure box and pallet, which provides good protection of the enclosure against breakage as well as ready and toolless assembly and disassembly of the integrated container, as in the embodiments described earlier. Moreover, the configuration with the single sheet 540 securing the pallet 510 to the enclosure box 120 reduces the number of components involved in the container 100, thus making it effortless to assemble or disassemble the container 100 according to this patent specification.

Numerous additional modifications and variations are possible in light of the above teachings. For example, pallets used in the packaging container according to this patent specification may be made of synthetic resin, metal, or any suitable material, and may be suitably sized and shaped depending on the intended application.

Further, although the enclosure box, the enclosure base, and the sheet described above are formed of corrugated cardboard, alternatively these components may be formed of corrugated plastic or any other suitable material, and may be suitably sized and shaped depending on the intended application.

Furthermore, fastening the sheet to the enclosure box may be performed by using a fastener of a mechanism and a material other than the plastic flanged-tube fastener as described herein, as long as it can connect the sheet and box walls by being inserted into aligned openings from outside the enclosure box.

It is therefore to be understood that, within the scope of the appended claims, the disclosure of this patent specification may be practiced otherwise than as specifically described herein.

What is claimed is:

1. A container used to package an article for handling with tines of a forklift, comprising:

a pallet to allow handling of the container with the forklift tines, the pallet including:

a bottom deck on which the pallet rests;

a top deck on which the article is placed; and a set of support members disposed between the top and bottom decks to form a hollow structure substantially rectangular in plan, with first and second pairs of opposed open sides substantially perpendicular to the top and bottom decks, the top deck defining first and second planes different from each other on a bottom side thereof inside the pallet hollow, the pallet hollow configured such that the forklift tines only enter through the first pair of opposed open sides in a given direction to contact the first plane of the top deck;

an enclosure base placed on the pallet top deck to support the article thereon;

an enclosure box placed above the pallet top deck around the enclosure base to enclose the article therewithin, the enclosure box including:

a top wall to cover the article from above;

first and second pairs of opposed side walls extending from the top wall to surround the article from all sides;

an open bottom defined by the first and second pairs of side walls opposite to the top wall to allow entry of the article during installation to the pallet top deck; and a first set of through-holes defined in the first pair of side walls adjacent to the open bottom;

at least one sheet passes through the pallet hollow structure and the at least one sheet is fastened to the enclosure box to connect the pallet to the enclosure box, the at least one sheet including:

a center panel extending between the second pair of opposed open sides along the second plane and apart from the first plane inside the pallet hollow;

a pair of side flaps extending upward from opposed ends of the center panel through the second pair of opposed open sides to beyond the first set of through-holes; and a second set of through-holes defined in the pair of side flaps to align with the first set of through-holes; and a set of fasteners passed through the first and second sets of through-holes to fasten the at least one sheet to the enclosure box from outside the enclosure box.

2. The container according to claim 1, wherein the second pair of opposed open sides of the pallet each defines an outer edge facing outward with respect to the upward extending side flap of the at least one sheet.

3. The container according to claim 1, wherein the at least one sheet further includes a backing member attached to the back of the center panel, the backing member having an exposed surface level with the first plane of the pallet top deck to contact the forklift tines entering the pallet hollow.

4. The container according to claim 1, wherein the at least one sheet further includes a pair of tabs extending from between the center panel and the respective side flaps for disposition between the top and bottom decks on the second pair of opposed open sides.

5. The container according to claim 1, wherein the top deck includes a pair of parallel deckboards extending along the first pair of opposed open sides perpendicular to the entry direction of the forklift tines, and spaced apart from each other to define a gap therebetween through which the center panel of the at least one sheet extends between the second pair of opposed open sides.

6. The container according to claim 1, wherein the top deck includes three or more parallel deckboards extending perpendicular to the entry direction of the forklift tines, and spaced apart from each other to define multiple gaps therebetween through each of which the center panel of the at least one sheet extends between the second pair of opposed open sides.

7. The container according to claim 1, wherein the enclosure base has a portion engaged in the pallet top deck to restrict movement over the pallet top deck.

8. The container according to claim 1, wherein the at least one sheet further includes a positioning tab extending from the center panel and held in contact with the pallet to position the at least one sheet with respect to the pallet.

9. The container according to claim 1, wherein each fastener of the set of fasteners comprises:

an open-ended tubular body, substantially oval in cross-section, having a flanged first end and a flange-less, open second end having a pair of opposed angled plates attached thereto, each plate forming an "L" in cross-section and hinged to an inner wall of the tubular body; and a plug hinged to the flange and sized to fit snugly within the interior of the tubular body, the plug located outside the tubular body when the fastener is not in use, such that the hinged plates point their free ends in the same direction, the flange-less end of the tubular body together with the plates insertable into an opening of a particular size, the plug inserted into the tubular body when the fastener is in use to cause the plates to turn away from each other on their respective hinges and point in opposite directions, thereby sandwiching walls of a certain thickness between the flange on the first end and the plates on the second end.

10. The container according to claim 1, wherein the set of fasteners is operated without using tools.

* * * * *